US011609005B2

(12) United States Patent
Bhosale

(10) Patent No.: US 11,609,005 B2
(45) Date of Patent: Mar. 21, 2023

(54) ADJUSTABLE HEAT EXCHANGER

(71) Applicant: Johnson Controls Technology Company, Auburn Hills, MI (US)

(72) Inventor: Anil V. Bhosale, District Satara (IN)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 375 days.

(21) Appl. No.: 16/146,051

(22) Filed: Sep. 28, 2018

(65) Prior Publication Data

US 2020/0103131 A1 Apr. 2, 2020

Related U.S. Application Data

(60) Provisional application No. 62/738,130, filed on Sep. 28, 2018.

(51) Int. Cl.

| | |
|---|---|
| ***F24F 11/30*** | (2018.01) |
| ***F24F 11/67*** | (2018.01) |
| ***F25B 49/02*** | (2006.01) |
| *F24F 140/20* | (2018.01) |
| *F24F 110/12* | (2018.01) |

(52) U.S. Cl.

CPC ..... *F24F 11/30* (2018.01); *F24F 11/67* (2018.01); *F25B 49/022* (2013.01); *F25B 49/027* (2013.01); *F24F 2110/12* (2018.01); *F24F 2140/20* (2018.01)

(58) Field of Classification Search

CPC ..... F24F 11/30; F24F 11/67; F24F 2110/12; F24F 2140/20; F25B 49/022; F25B 49/027

See application file for complete search history.

(56) References Cited

U.S. PATENT DOCUMENTS

| | | | | |
|---|---|---|---|---|
| 2,147,283 | A | 2/1939 | Covell | |
| 2,189,494 | A * | 2/1940 | Kucherandrewa .... | F25D 23/003 62/454 |
| 2,729,072 | A | 1/1956 | Dybvig | |
| 2,891,387 | A | 6/1959 | Cocanour | |
| 3,285,327 | A | 11/1966 | Herrick | |
| 4,151,874 | A | 5/1979 | Kaburagi et al. | |
| 4,239,518 | A | 12/1980 | Steelman | |
| 4,574,872 | A | 3/1986 | Yano et al. | |
| 4,621,683 | A | 11/1986 | Knab | |
| 4,911,234 | A | 3/1990 | Heberer et al. | |
| 5,237,831 | A | 8/1993 | Sikora | |
| 5,582,026 | A | 12/1996 | Barto, Sr. | |
| 5,896,751 | A | 4/1999 | Wakizaka et al. | |
| 6,119,463 | A | 9/2000 | Bell | |

(Continued)

FOREIGN PATENT DOCUMENTS

| | | |
|---|---|---|
| DE | 3235686 A1 | 9/1983 |
| DE | 29715805 U1 | 3/1998 |

(Continued)

*Primary Examiner* — Nael N Babaa
(74) *Attorney, Agent, or Firm* — Fletcher Yoder, P.C.

(57) ABSTRACT

A heating, ventilation, and/or air conditioning (HVAC) system, includes a housing configured to direct an air flow through an air flow path of the housing and an evaporator configured to translate between a first position and a second position, such that the evaporator is disposed within the air flow path in the first position and the evaporator is disposed external to the air flow path in the second position.

27 Claims, 10 Drawing Sheets

(56) References Cited

U.S. PATENT DOCUMENTS

| | | | | |
|---|---|---|---|---|
| 6,484,799 | B1 | 11/2002 | Irish | |
| 6,622,508 | B2 | 9/2003 | Dinnage et al. | |
| 6,907,739 | B2 | 6/2005 | Bell | |
| 7,746,634 | B2 | 6/2010 | Hom et al. | |
| 7,849,913 | B2 | 12/2010 | Struensee | |
| 2003/0061818 | A1 | 4/2003 | Nash et al. | |
| 2004/0079100 | A1* | 4/2004 | Monfarad | F04B 35/045 62/259.2 |
| 2004/0212211 | A1* | 10/2004 | Beckley | B60H 1/00514 296/70 |
| 2009/0084117 | A1* | 4/2009 | Czerwonky | F25D 19/02 62/448 |
| 2011/0146651 | A1 | 6/2011 | Puranen et al. | |
| 2016/0047562 | A1* | 2/2016 | Bartlett | B60H 1/00 62/115 |
| 2016/0328349 | A1* | 11/2016 | Kunnathur Ragupathi | G06F 13/4068 |
| 2018/0356124 | A1 | 12/2018 | Gupte et al. | |
| 2018/0372383 | A1* | 12/2018 | DeMonte | F25B 39/04 |

FOREIGN PATENT DOCUMENTS

| | | | |
|---|---|---|---|
| JP | 2001047845 | A | 2/2001 |
| WO | 2012011865 | | 1/2012 |

* cited by examiner

ADJUSTABLE HEAT EXCHANGER

CROSS REFERENCE TO RELATED APPLICATIONS

This application claims priority from and the benefit of U.S. Provisional Application Ser. No. 62/738,130, entitled "ADJUSTABLE HEAT EXCHANGER," filed Sep. 28, 2018, which is hereby incorporated by reference in its entirety for all purposes.

BACKGROUND

The disclosure relates generally to heating, ventilation, and/or air conditioning (HVAC) systems, and specifically, relates generally to adjusting a position of a heat exchanger in HVAC systems.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Environmental control systems are utilized in residential, commercial, and industrial environments to control environmental properties, such as temperature and humidity, for occupants of the respective environments. The environmental control system may control the environmental properties through control of an air flow delivered to and ventilated from the environment. For example, the air flow may be directed through an air flow path of an HVAC system, where heat is exchanged between the air flow and a refrigerant flowing through the HVAC system in a heat exchanger disposed in the air flow path. In some embodiments, operation of the heat exchanger is configured to be disabled or suspended such that heat is not exchanged between the air flow and the refrigerant during certain operating modes of the HVAC system. However, the air flow may still be directed across the non-operational heat exchanger in such operating modes. It is now recognized that directing the air flow across the heat exchanger when the heat exchanger is not in operation may decrease an efficiency of the HVAC system.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, and/or air conditioning (HVAC) system, includes a housing configured to direct an air flow through an air flow path of the housing and an evaporator configured to translate between a first position and a second position, such that the evaporator is disposed within the air flow path in the first position and the evaporator is disposed external to the air flow path in the second position.

In one embodiment, a controller for a heating, ventilation, and/or air conditioning (HVAC) system, comprising a tangible, non-transitory, computer-readable medium having computer-executable instructions stored thereon that, when executed, cause a processor to operate the HVAC system in a first mode and operate the HVAC system in a second mode. In the first mode, the HVAC system is configured to direct air through an air flow path of the HVAC system and across an evaporator disposed within the air flow path. In the second mode, the HVAC system is configured to substantially remove the evaporator from the air flow path and direct air through the air flow path of the HVAC system and adjacent to the evaporator substantially removed from the air flow path.

In one embodiment, a heating, ventilation, and/or air conditioning (HVAC) unit, includes a housing configured to direct an air flow through an air flow path of the housing, an evaporator configured to translate between a first position within the air flow path and a second position external to the air flow path, and a controller configured to control an actuator to translate the evaporator between the first position and the second position based on an operating mode of the HVAC unit.

DRAWINGS

Various aspects of this disclosure may be better understood upon reading the following detailed description and upon reference to the drawings in which.

DETAILED DESCRIPTION

Figure 1:
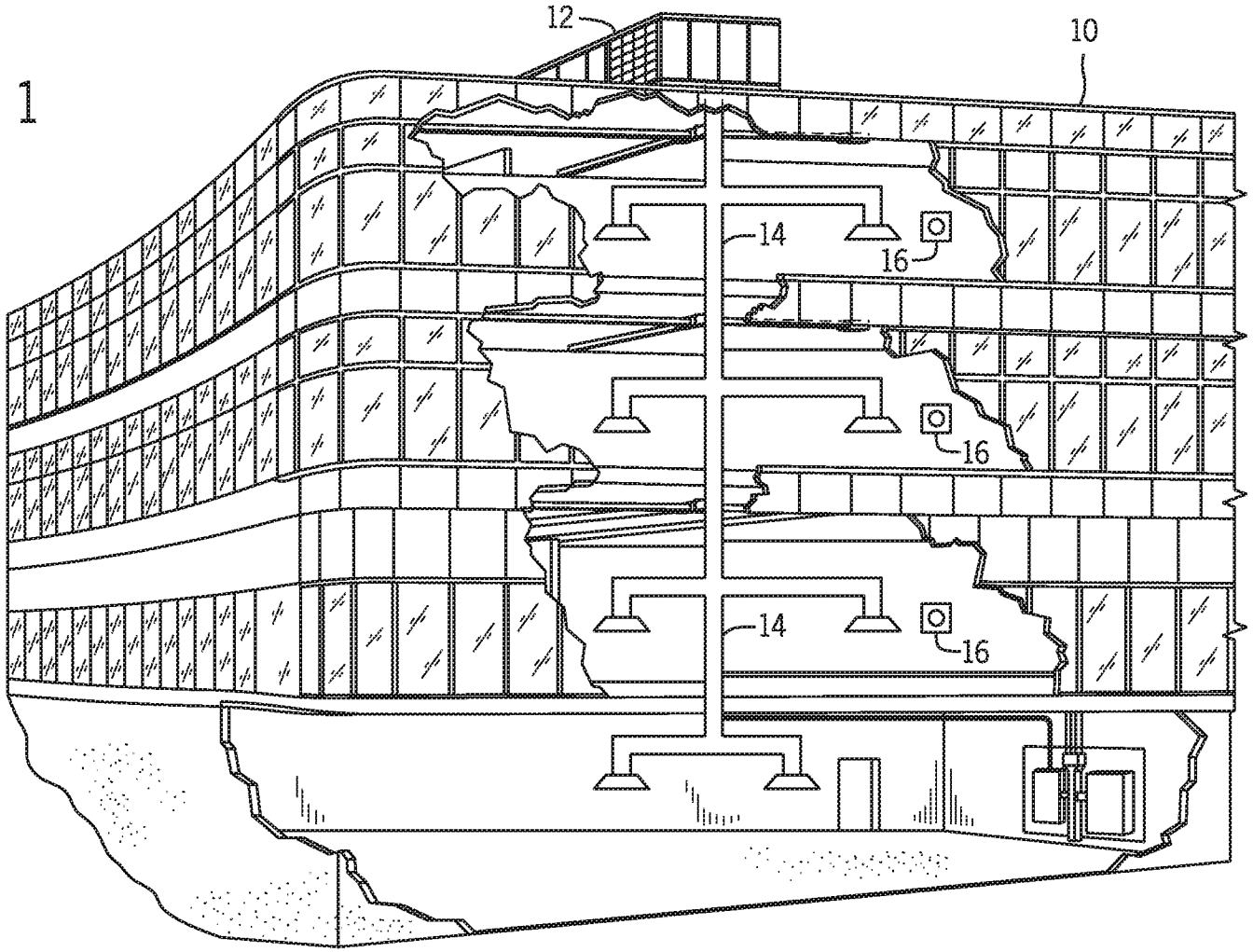
FIG. 1 is a schematic of an embodiment of an environmental control for building environmental management that may employ one or more HVAC units, in accordance with an aspect of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present disclosure is directed to heating, ventilation, and/or air conditioning (HVAC) systems that use a heat exchanger for transferring heat between a refrigerant and air conditioned by the HVAC system. In some embodiments, the heat exchanger is disposed within an air flow path such that the air is directed across coils of the heat exchanger and is placed in thermal communication with a refrigerant flowing through the coils. After heat is exchanged between the air flow and the refrigerant, the air flow may be directed to spaces to be conditioned and otherwise serviced by the HVAC system. As the air flow is directed through the air flow path, pressure losses, such as from friction when flowing across the heat exchanger, may decrease the velocity of the air flow. Thus, the HVAC system may use an air moving device, such as a blower, to increase the velocity of air flow to a desired velocity for supplying the air flow to a conditioned space.

As mentioned above, when the heat exchanger is in operation, refrigerant is directed through the heat exchanger to enable heat transfer between the refrigerant and the air flow as the air flow passes across the heat exchanger. Generally, the HVAC system is configured to operate in a cooling mode and/or a heating mode, but the heat exchanger may not be operable to condition the air flow in either mode. For example, in one of the modes, the refrigerant may not be used to transfer heat with the air flow. Thus, operation of the heat exchanger may be suspended, and the refrigerant may not flow through the heat exchanger, to conserve power. However, the heat exchanger may still remain within the air flow path when not operational, and therefore the air flow may still be directed across the heat exchanger. As a result, the air flow may experience pressure loss when flowing across the heat exchanger.

Thus, in accordance with certain embodiments of the present disclosure, it is presently recognized that adjusting a position of the heat exchanger based on an operating mode of the HVAC system may improve operation of the HVAC system. More specifically, when the HVAC system is operating in a mode where operation of the heat exchanger is suspended, the heat exchanger may be transitioned from a first or operational position, where the heat exchanger is disposed within the air flow path, to a second or non-operational position, where the heat exchanger is substantially removed from the air flow path. For example, the heat exchanger may be translated to a position where the heat exchanger is adjacent to the air flow path, such that the air flow does not flow across the heat exchanger during HVAC system operation. In this manner, pressure loss of the air flow may be reduced when the HVAC system is operating in a mode where the heat exchanger is not operational. That is, if the air flow is not directed across the heat exchanger when the heat exchanger is not operating, an undesired decrease in velocity of the air flow may be reduced or avoided. As a result, the HVAC system may operate more efficiently in the operating mode where the heat exchanger is not operational. Specifically, the substantial removal of the heat exchanger from the air flow path when the heat exchanger is not operational enables the air flow to bypass the heat exchanger, thereby reducing or avoiding a decrease in velocity of the air flow. As a result, an air moving device of the HVAC system that increases the velocity of the air flow may operate at a lower power to increase the efficiency of the HVAC system.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof Δn "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
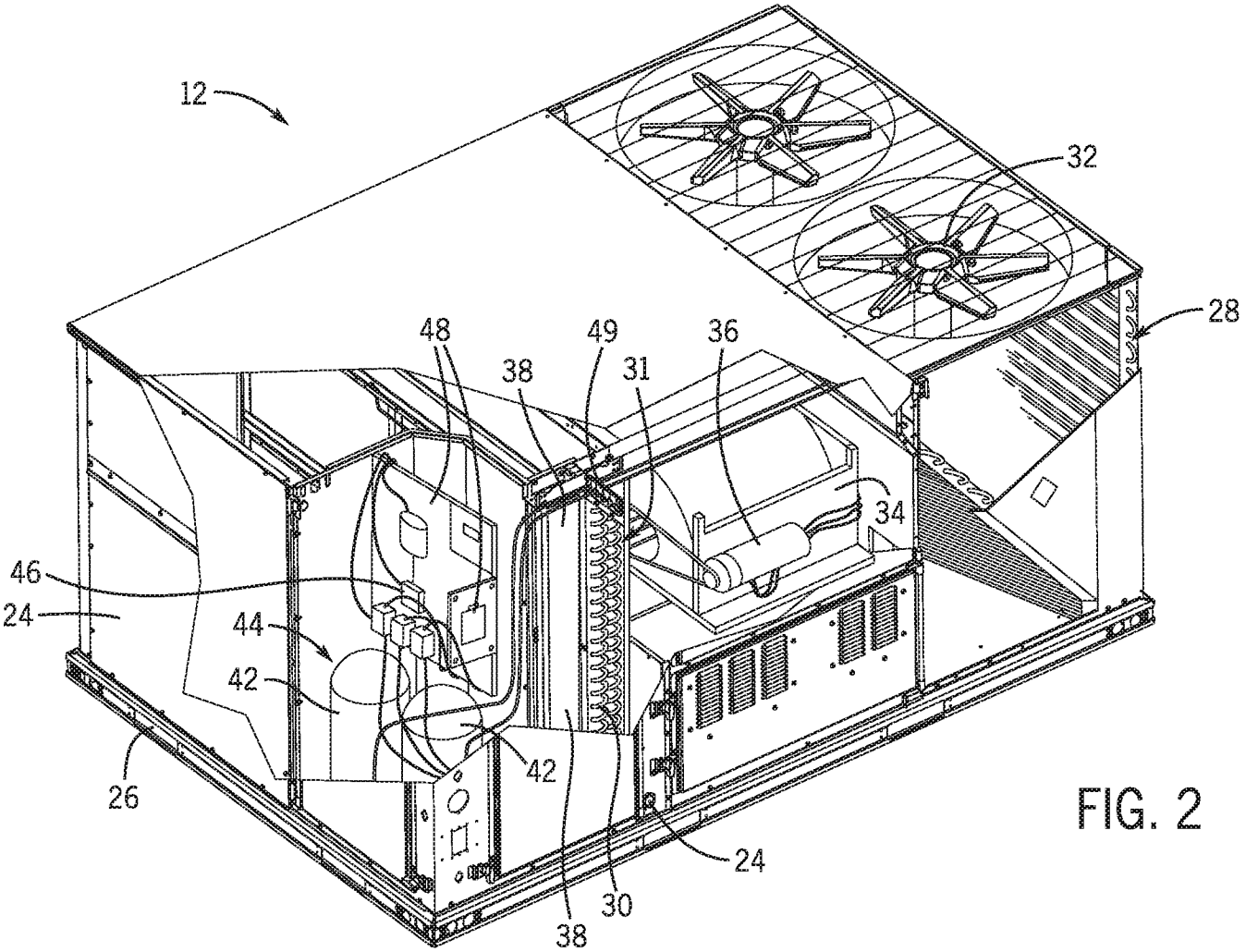
FIG. 2 is a perspective view of an embodiment of an HVAC unit that may be used in the environmental control system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
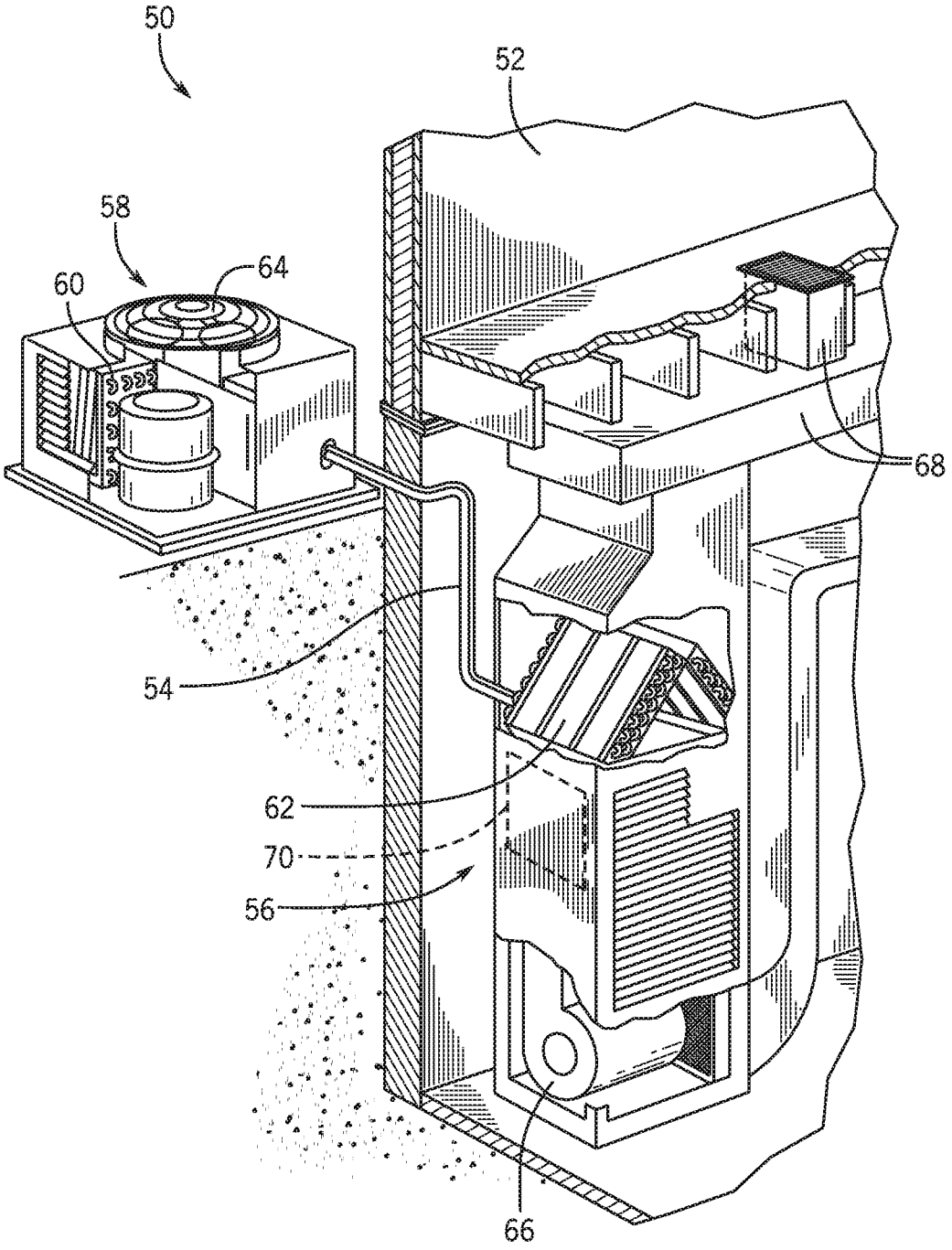
FIG. 3 is a schematic of an embodiment of a residential heating and cooling system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
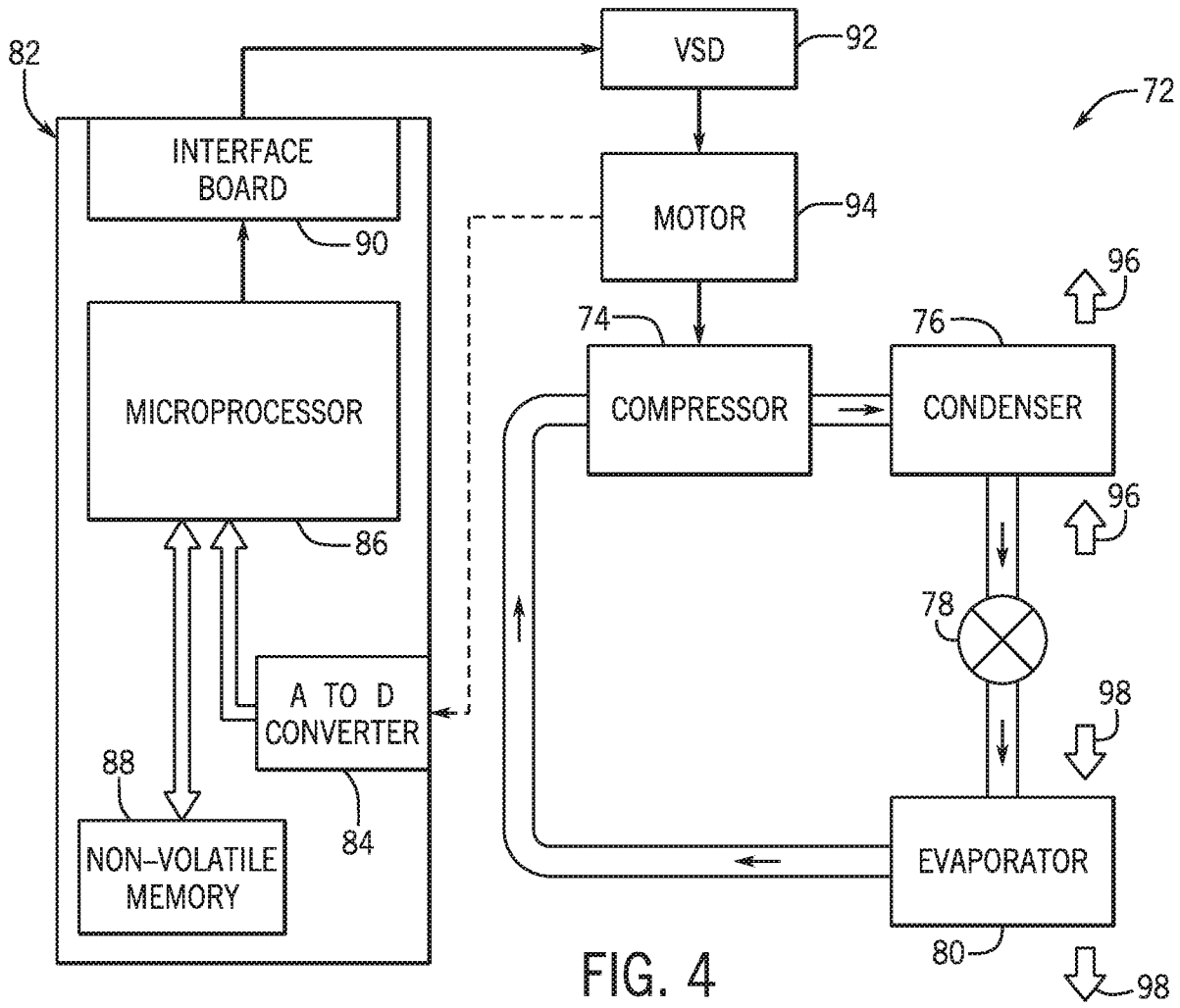
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As discussed above, an HVAC system, such as the HVAC system of FIGS. 1-4, is configured to direct an air flow through an air flow path in the HVAC system. Additionally, a refrigerant may flow within a heat exchanger of the HVAC system that is disposed along the air flow path. The heat exchanger is configured to place the air flow and the refrigerant in thermal communication with one another. For example, the heat exchanger includes coils through which the refrigerant flows to enable heat exchange between the refrigerant and the air flow flowing across the heat exchanger. A velocity of the air flow may decrease as the air flow is directed across the coils. To increase the velocity of the air flow, the HVAC system may include an air moving device configured to increase the velocity of the air flow downstream of the heat exchanger or upstream of the heat exchanger.

In some embodiments, the HVAC system is configured to operate in different operating modes, and operation of the heat exchanger may be suspended in one or more of the operating modes. That is, in certain operating modes, the heat exchanger may not be utilized to condition the air flow to be supplied to a conditioned space. In such operating modes, and in accordance with present embodiments, the HVAC system is configured to transition the heat exchanger from a position within the air flow path to a position substantially removed from the air flow path, such that the air flow bypasses the heat exchanger during HVAC system operation. With the heat exchanger substantially removed from the air flow path, the air flow flowing through the HVAC system bypasses the heat exchanger, which may reduce a pressure loss, and a resulting decrease in velocity, of the air flow. Thus, an air moving device of the HVAC system configured to force the air flow through the HVAC system may operate at a lower power while still supplying the air flow to the conditioned space at a desired flow rate. For purposes of discussion, the present disclosure refers to the heat exchanger as it may be utilized in a packaged unit, such as the HVAC unit 12 of FIGS. 1 and 2. However, it should be understood the systems and concepts described below may be used in other types of HVAC systems, such as the residential heating and cooling system 50 of FIG. 3.

Figure 5:
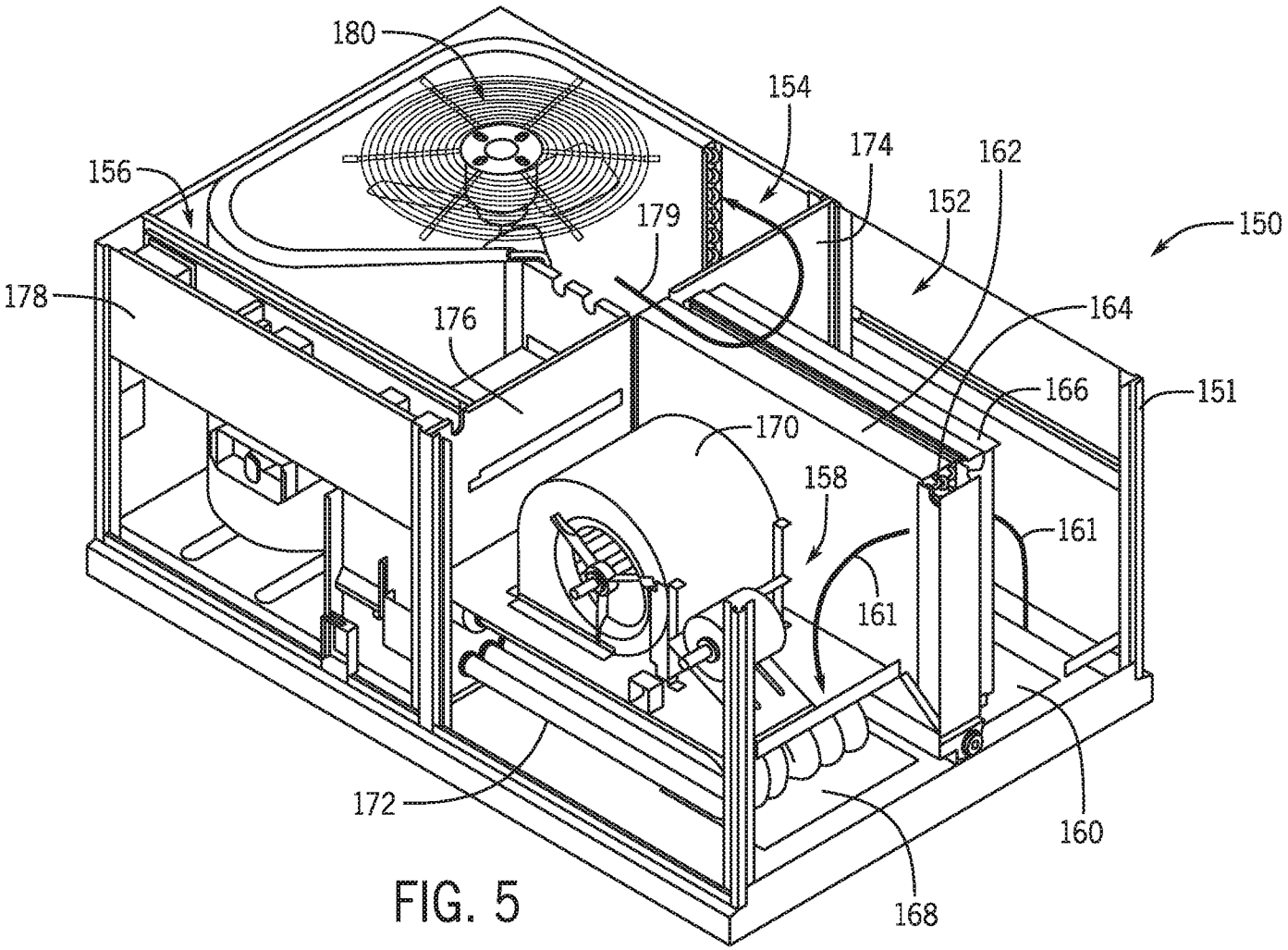
FIG. 5 is a perspective view of an embodiment of an HVAC system having a heat exchanger configured to adjust positions within the HVAC system, illustrating the heat exchanger disposed within an air flow path of the HVAC system, in accordance with an aspect of the present disclosure.

To illustrate an HVAC system including an adjustable heat exchanger in accordance with present embodiments, FIG. 5 is a perspective view of an embodiment of an HVAC system 150, which may be a packaged HVAC unit. The HVAC system 150 may include a housing 151 through which an air flow may be directed and conditioned therethrough. As illustrated in FIG. 5, the housing 151 includes a first volume 152, a second volume 154, a third volume 156, and a fourth volume 158. As will be appreciated, each volume 152, 154, 156, 158 may include a particular section within the housing 151 defined by structural members, such as panels, borders, frame members, and/or enclosures. Each volume 152, 154, 156, 158 may also include internal components of the HVAC system. In some embodiments, the internal components of different volumes 152, 154, 156, 158 are separated and/or isolated from one another. In FIG. 5, several of the structural members are substantially removed to illustrate the internal components within each of the volumes 152, 154, 156, 158. The first volume 152 includes a return air section 160 or inlet. An air flow, such as a return air flow from a conditioned space serviced by the HVAC system 150, is configured to enter the housing 151 via the return air section 160 to begin circulation through an air flow path 161 of the HVAC system 150. The first volume 152 also includes an evaporator 162 configured to place the air flow in thermal communication with a refrigerant flowing through coils 164 of the evaporator 162. In operation, the refrigerant flowing through the coils 164 of the evaporator 162 may remove heat from the air flow passing across the evaporator 162. For example, the evaporator 162 may be operated during a cooling mode of the HVAC system 150.

In FIG. 5, the evaporator 162 is disposed within the air flow path 161, thereby enabling the air flow to be directed across the evaporator 162 after entering the first volume 152. In some embodiments, the HVAC system 150 includes a filter 166 positioned upstream of the evaporator 162 in the air flow path 161. The filter 166 may remove particles from the air flow, such as dirt and other debris. The filter 166 may be any suitable structure configured to remove one or more particles or components from the air flow, such as a pleated filter, an electrostatic filter, a high-efficiency particulate air (HEPA) filter, or a fiber glass filter that traps the debris when the air flow passes through the filter 166.

The evaporator 162 may at least partially separate the first volume 152 and the fourth volume 158. As such, when the air flow is directed across the evaporator 162, the air flow exits the first volume 152 and enters the fourth volume 158 of the HVAC system 150 along the air flow path 161. The fourth volume 158 may include a supply air section 168 or outlet, which may be coupled to conditioned spaces serviced by the HVAC system 150. For example, the supply air section 168 may be fluidly coupled to ducts of a building that receive the air flow exiting the HVAC system 150 via the supply section 168 and distribute the air flow to conditioned spaces within the building.

As mentioned, the air flow may enter the HVAC system 150, such as via the return air section 160, at an initial velocity and may exit the HVAC system 150, such as via the supply air section 168, at a desired velocity. However, as the air flow is directed through the HVAC system 150, the velocity of the air flow may decrease below the desired velocity. Thus, the HVAC system 150 may include a blower 170 configured to increase the velocity of the air flow and direct the air flow to exit the supply air section 168 at the desired velocity.

In some embodiments, a heat exchanger 172 is positioned downstream of the blower 170 in the air flow path 161 and is configured to place the air flow in thermal communication with a fluid flowing through the heat exchanger 172. For example, the heat exchanger 172 may place the air flow in thermal communication with a heated fluid, such as combustion products, to add heat to the air flow to increase a temperature of the air flow exiting the supply section 168. Thus, the heat exchanger 172 may be configured to operate to heat the air flow in a heating mode of the HVAC system 150, whereas the evaporator 162 may be configured to operate to cool the air flow in a cooling mode of the HVAC system 150.

The HVAC system 150 may include a first partition 174 disposed in between the first volume 152 and the second volume 154 to block the air flow from traveling between the first volume 152 and the second volume 154. Additionally, the HVAC system 150 may include a second partition 176 disposed between the third volume 156 and the fourth volume 158 to block the air flow from traveling between the third volume 156 and the fourth volume 158. The first partition 174 and the second partition 176 may contain the air flow within the air flow path 161 such that the air flow is directed from the first volume 152 to the fourth volume 158 in both the heating mode and the cooling mode.

In certain embodiments, a controller 178 may determine the operating mode of the HVAC system 150. For example, the controller 178 is disposed in the third volume 156 in the illustrated embodiment. The controller 178, which may be substantially similar to the control panel 82, may include a memory with stored instructions for operating the HVAC system 150, including determining the operating mode for the HVAC system 150. The controller 178 may also include a processor configured to execute such instructions. For example, the processor may include one or more application specific integrated circuits (ASICs), one or more field programmable gate arrays (FPGAs), one or more general purpose processors, or any combination thereof. Additionally, the memory may include volatile memory, such as random access memory (RAM), and/or non-volatile memory, such as read-only memory (ROM), optical drives, hard disc drives, or solid-state drives. Although FIG. 5 illustrates the controller 178 disposed in the third volume 156, in additional or alternative embodiments, the controller 178 may be disposed elsewhere in the HVAC system 150 and/or disposed externally to the HVAC system 150.

The controller 178 may determine the operating mode of the HVAC system 150 based at least in part on a desired temperature for spaces to be conditioned and serviced by the HVAC system 150. Based on the operating mode selected or determined, the controller 178 may suspend operation of certain components of the HVAC system 150 to conserve power to operate the HVAC system 150. For example, if a desired temperature of the space is greater than a current temperature of the space, the controller 178 may determine that the HVAC system 150 should operate in a heating mode. The controller 178 may be configured to make this determination based on feedback, such as temperature data of the conditioned space and/or a conditioned space temperature setpoint. In the heating mode, the controller 178 may operate the heat exchanger 172 to heat the air flow, while suspending operation of the evaporator 162 that is configured to cool the air flow. If the desired temperature of the space is less than a current temperature of the space, the controller 178 may determine that the HVAC system 150 should operate in a cooling mode. In the cooling mode, the controller 178 may operate the evaporator 162 to cool the air flow, while suspending operation of the heat exchanger 172 that is configured to heat the fluid.

As the air flow is directed through the air flow path 161, the refrigerant may circulate a refrigerant circuit 179 of the HVAC system 150. For example, after the refrigerant absorbs heat from the air flow in the evaporator 162, the heated refrigerant may be directed from the evaporator 162 disposed in the first volume 152 to a condenser 180 disposed in the second volume 154. The refrigerant is cooled within the condenser 180 by air, such as ambient air, flowing across the condenser 180. In some embodiments, the condenser 180 may use a fan or a group of fans to force air across the condenser 180 to remove heat from the refrigerant and reject the heat from the HVAC system 150. After being cooled in the condenser 180, the refrigerant may flow to the evaporator 162 again to continue to remove heat from the air flow, such as when the HVAC system 150 is operating in the cooling mode. As will be appreciated, the refrigerant circuit 179 may include a compressor and/or an expansion valve configured to change a pressure and/or a temperature of the refrigerant as the refrigerant is directed through the refrigerant circuit 179. Adjusting the pressure and/or temperature of the refrigerant may increase/decrease the amount of heat exchanged between the air flow and the refrigerant within the evaporator 162 and/or the amount of heat removed from the refrigerant in the condenser 180. As will be appreciated, the HVAC system 150 may include other components operable to enable desired heat transfer to and from the air flow. In this manner, the HVAC system 150 may monitor and/or adjust characteristics or a quality of the air flow that is supplied to spaces conditioned by the HVAC system 150.

Figure 6:
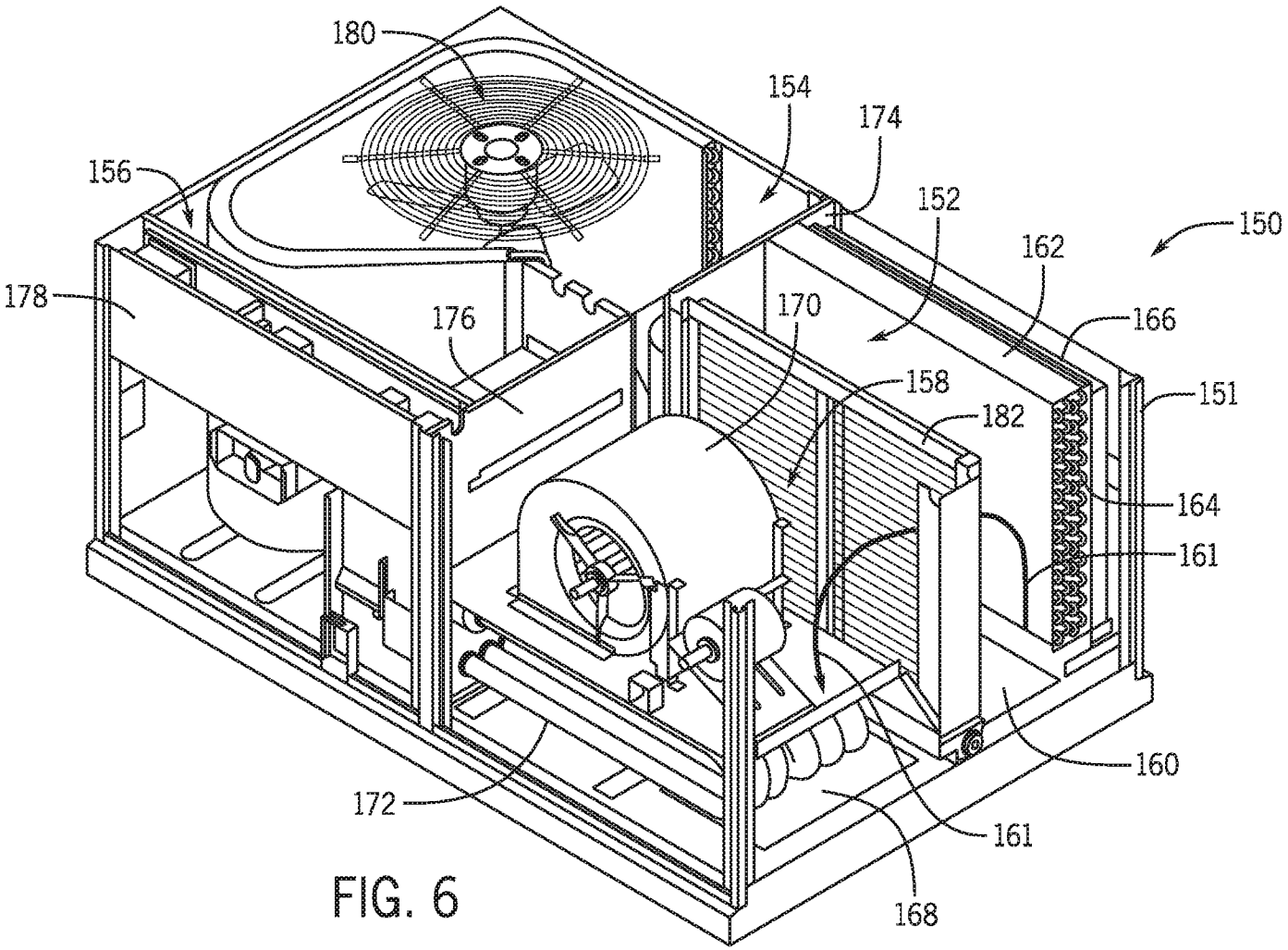
FIG. 6 is a perspective view of an embodiment of the HVAC system of FIG. 5 having a heat exchanger configured to adjust positions within the HVAC system, illustrating the heat exchanger removed from or adjacent to the air flow path, in accordance with an aspect of the present disclosure.

In some embodiments, the evaporator 162 and/or the filter 166 may be configured to translate out of the air flow path 161, such as depending on an operating mode of the HVAC system 150. To illustrate, FIG. 6 is a perspective view of an embodiment of the HVAC system 150 that includes the evaporator 162 and the filter 166 substantially removed from the air flow path 161. As mentioned, if the HVAC system 150 is in the heating mode, operation of the evaporator 162 may be suspended because the evaporator 162 is not utilized to reduce a temperature of the air flow in the heating mode. By suspending operation of the evaporator 162, power consumption of the HVAC system 150 may be reduced. For example, the controller 178 of the HVAC system 150 may suspend operation of a compressor configured to circulate refrigerant through the refrigerant circuit 179 having the evaporator 162.

With operation of the evaporator 162 suspended in the heating mode, it may also be beneficial to adjust the position of the evaporator 162 to be substantially removed from the air flow path 161, such that the air flow bypasses the evaporator 162. In other words, the air flow may circulate through the HVAC system 150, and may be heated by the heat exchanger 172, without flowing across the evaporator 162. As a result of the air flow bypassing the evaporator 162, a decrease in the velocity of the air flow is reduced. For example, if the position of the evaporator 162 within the HVAC system 150 is adjusted to be substantially removed from the air flow path 161 within the HVAC system 150, a velocity of the air flow entering the fourth volume 158 may be closer to the desired velocity of the air flow exiting the supply air section 168 as compared to a velocity of the air flow entering the fourth volume 158 after flowing across the evaporator 162 disposed within the air flow path 161. In other words, with the evaporator 162 substantially removed from the air flow path 161 when the evaporator 162 is non-operational, the fluidic resistance of the evaporator 162 with regard to the air flow is reduced. As such, the blower 170 may be operated at a lower power to achieve a desired velocity of the air flow exiting the HVAC system 150 through the supply air section 168, and power consumption of the HVAC system 150 is further reduced.

The position of the evaporator 162 within the HVAC system 150 may be adjusted manually or automatically, such as via a controller 178. For example, the controller 178 may be configured to adjust the position of the evaporator 162 based on an operating mode of the HVAC system 150. As used herein, "based on" includes embodiments in which the position of the evaporator 162 is adjusted or modified based at least in part on the operating mode of the HVAC system 150. For example, when the HVAC system 150 is in a cooling mode, the evaporator 162 may be positioned within the air flow path 161 to remove heat from the air flow. In other words, the evaporator 162 may be positioned within the HVAC system 150 such that all or substantially all of the air flow is directed across the evaporator 162 when passing from the first volume 152 to the fourth volume 158.

When the HVAC system 150 is operating in a heating mode and the evaporator 162 is non-operational, the evaporator 162 may be positioned substantially out of the air flow path 161, such that the air flow flowing through the HVAC system 150 bypasses the evaporator 162. In other words, the evaporator 162 may be positioned within the HVAC system 150 such that all or substantially all of the air flow is directed from the first volume 152 to the fourth volume 158 without flowing across the evaporator 162.

In certain embodiments, the position of the filter 166 may also be adjusted within the HVAC system 150, such as based on an operational mode of the HVAC system 150. For example, when the position of the evaporator 162 is adjusted to be substantially removed from the air flow path 161, such as in a heating mode, the filter 166 may also be translated with the evaporator 162, such that the filter 166 is also substantially removed from the air flow path 161. Similarly, when the position of the evaporator 162 is adjusted to be within the air flow path, such as in a cooling mode, the filter 166 may also be translated with the evaporator 162, such that the filter 166 is also within the air flow path 161. Additionally or alternatively, the filter 166 may be configured to translate separately from the evaporator 162. Translating the filter 166 to substantially remove the filter 166 from the air flow path 161 may reduce the fluidic resistance caused by the filter 166 and encountered by the air flow, thereby reducing the velocity decrease of the air flow.

In some embodiments, there may be an additional filter 182 disposed in the HVAC system 150. The additional filter 182 may be positioned downstream of the evaporator 162 relative to the air flow, such that the air flow is filtered when the evaporator 162 and the filter 166 are substantially removed from the air flow path 161. In this manner, debris or other particulates may be removed from the air flow during a heating mode of the HVAC system 150 when the evaporator 162 and filter 166 are substantially removed from the air flow path 161. In such embodiments, the additional filter 182 may be disposed between the first volume 152 and the fourth volume 158 and may remain stationary while positions of the evaporator 162 and the filter 166 are adjusted.

Figure 7:
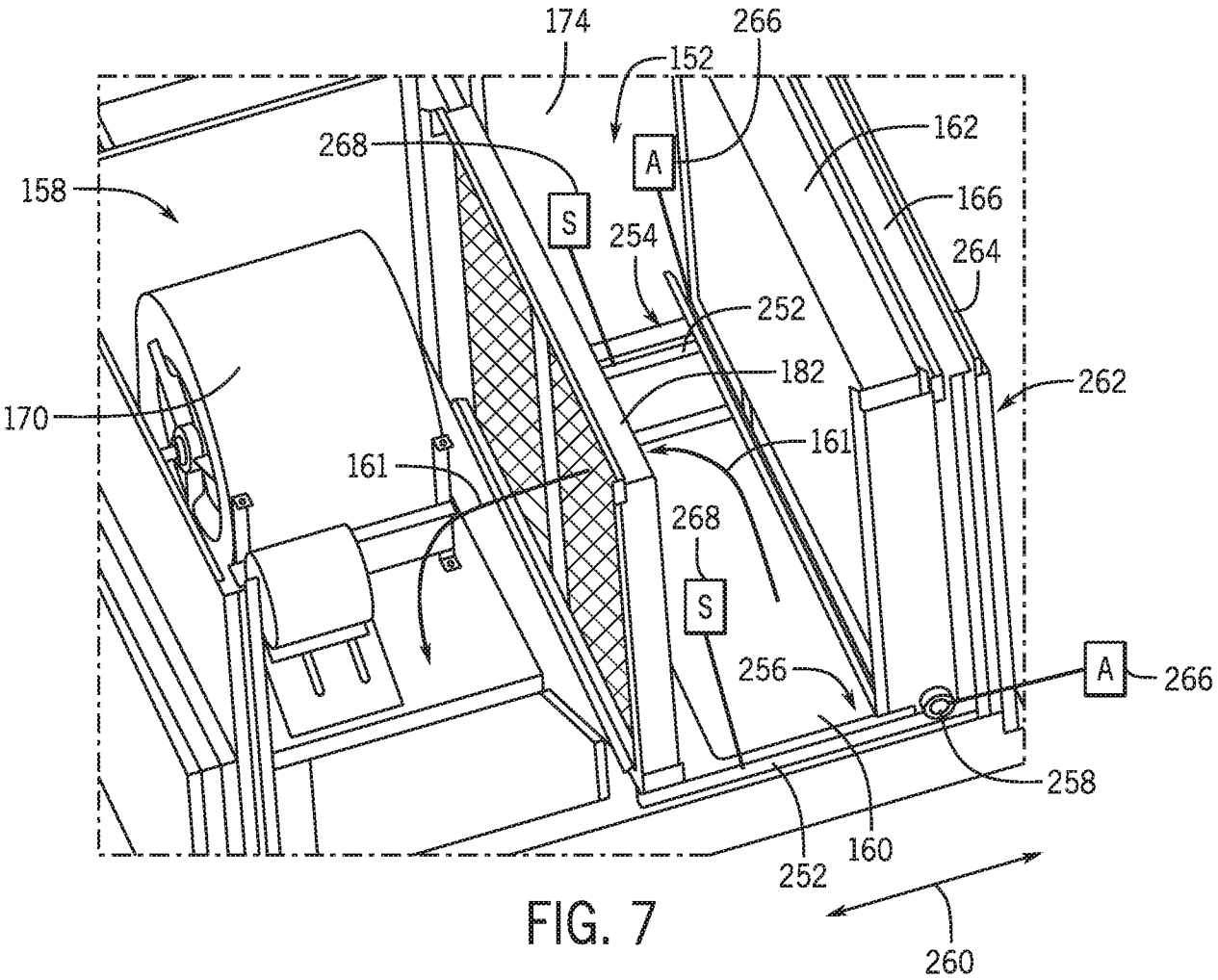
FIG. 7 is a partial perspective view of an embodiment of the HVAC system of FIGS. 5 and 6, illustrating the heat exchanger removed from or adjacent to the air flow path, in accordance with an aspect of the present disclosure.

To illustrate how the position of the evaporator 162 may be adjusted, FIG. 7 is a perspective view of the first volume 152 and the second volume 158 of the HVAC system 150. As shown in FIG. 7, the first volume 152 includes the evaporator 162 and the filter 166 disposed adjacent to the evaporator 162. More particularly, the evaporator 162 and the filter 166 are substantially removed from the air flow path 161 extending through the first volume 152 from the return air section 160 to the second volume 158. In particular, the evaporator 162 and the filter 166 are both positioned apart from the additional filter 182, such that the evaporator 162 and the filter 166 are substantially removed from the air flow path 161. That is, when the air flow enters the return section 160, the air flow is directed through the first volume 152 and to the additional filter 182 without passing through the filter 166 and the evaporator 162. In the illustrated position, the evaporator 162 partially forms a boundary of the air flow path 161 within the first volume 152 but is not positioned within the air flow path 161. Additionally, the filter 166 is positioned between the evaporator 162 and a panel of the HVAC system 150 and is not exposed to the air flow path 161 or the air flow. Hence, the evaporator 162 and filter 166 may be considered removed or substantially removed from the air flow path 161 because the air flow passing from the return air section 160 to the additional filter 182 does not flow through the evaporator 162 or the filter 166.

In some embodiments, the first volume 152 includes rails 252 that support the evaporator 162 and the filter 166. In particular, the evaporator 162 and filter 166 are positioned on top of the rails 252 on opposite lateral sides of the evaporator 162 and filter 166. One of the rails 252 is disposed on a first side 254 of the evaporator 162 and filter 166 adjacent to the first partition 174, and another of the rails 252 is positioned on a second side 256 of the evaporator 162 and filter 166 opposite the first side 254. The evaporator 162 and the filter 166 are configured to linearly translate along the rails 252 to transition between a position within the air flow path 161 and a position substantially removed from the air flow path 161. To this end, the evaporator 162 and/or the filter 166 include sliders 258 that engage with the rails 252. For example, the sliders 258 may be rollers, bearings, gears, or other translation mechanism configured to engage with the rails 252, which may define a trough, channel, groove, or other geometry configured to captures and guide movement of the sliders 258. The sliders 258 may be configured to linearly translate in directions 260 along the rails 252 to move the evaporator 162 and/or the filter 166 along the rails 252 and between positions. The rails 252 may extend from a position adjacent to the second volume 158 to a third side 262 of the first volume 152, such as an exterior panel or housing portion of the HVAC system 150. As such, when the evaporator 162 is positioned within the air flow path 161, the evaporator 162 may abut against the additional filter 182, which may remain stationary or fixed relative to the rails 252, and the filter 166 may abut the evaporator 162. When the evaporator 162 and filter 166 are removed or substantially removed from the air flow path 161, the filter 166 may abut against a housing wall 264 of the HVAC system 150. In this position, the evaporator 162 and the filter 166 does not interfere with the flow of air entering the first volume 152 via the return air section 160. In other words, the air flow passing through the first volume 152 may bypass the evaporator 162 and the filter 166.

To facilitate movement of the evaporator 162 and/or the filter 166 along the rails 252, the sliders 258 may include actuators 266. The actuators 266 may be hydraulic actuators, pneumatic actuators, electromechanical actuators, another suitable actuator, or any combination thereof, configured to linearly translate the sliders 258 along the rails 252 to position the evaporator 162 and/or the filter 166 at a desired location. The actuators 266 may be communicatively coupled to the controller 178 such that the controller 178 may regulate operation of the actuators 266. Additionally, there may be sensors 268 disposed in the first volume 152, such as on the rails 252. The sensors 268 may be configured to determine the position of the evaporator 162 and/or the filter 166. The sensors 268 may also be communicatively coupled to the controller 178 such that the controller 178 may utilize feedback from the sensors 268 to determine if the evaporator 162 and/or the filter 166 are positioned correctly. If the sensors 268 determine that the evaporator 162 and/or the filter 166 are not positioned correctly, the sensors 268 may transmit information to the controller 178 to enable the controller 178 to activate the actuators 266 to further translate the evaporator 162 and/or the filter 166 to a desired position. The sensors 268 may use pressure, current, light, another parameter, or any combination thereof, to determine the position of the evaporator 162 and/or the filter 166. Additionally or alternatively, the sensors 268 may monitor temperature of the air flow in the HVAC system 150. As an example, the sensors 268 may monitor the temperature of the air flow entering the first volume 152 from the return air section 160, and the controller 178 may use temperature feedback from the sensors 268, among other feedback, to determine an appropriate operating mode of the HVAC system 150 and a corresponding desired position of the evaporator 162 and/or the filter 166 associated with the appropriate operating mode.

In some embodiments, the filter 166 is coupled to the evaporator 162 as an assembly, such that the evaporator 162 and filter 166 translate along the rails 252 as a single unit. In additional or alternative embodiments, the evaporator 162 and the filter 166 include separate sliders 258, each of which may include actuators 266. In this manner, the evaporator 162 and the filter 166 may be configured to move independently from one another. It should also be appreciated that, in certain embodiments, the additional filter 182 may also include sliders 258 and actuators 266 as well and thus, may also linearly translate along the rails 252.

Figure 8:
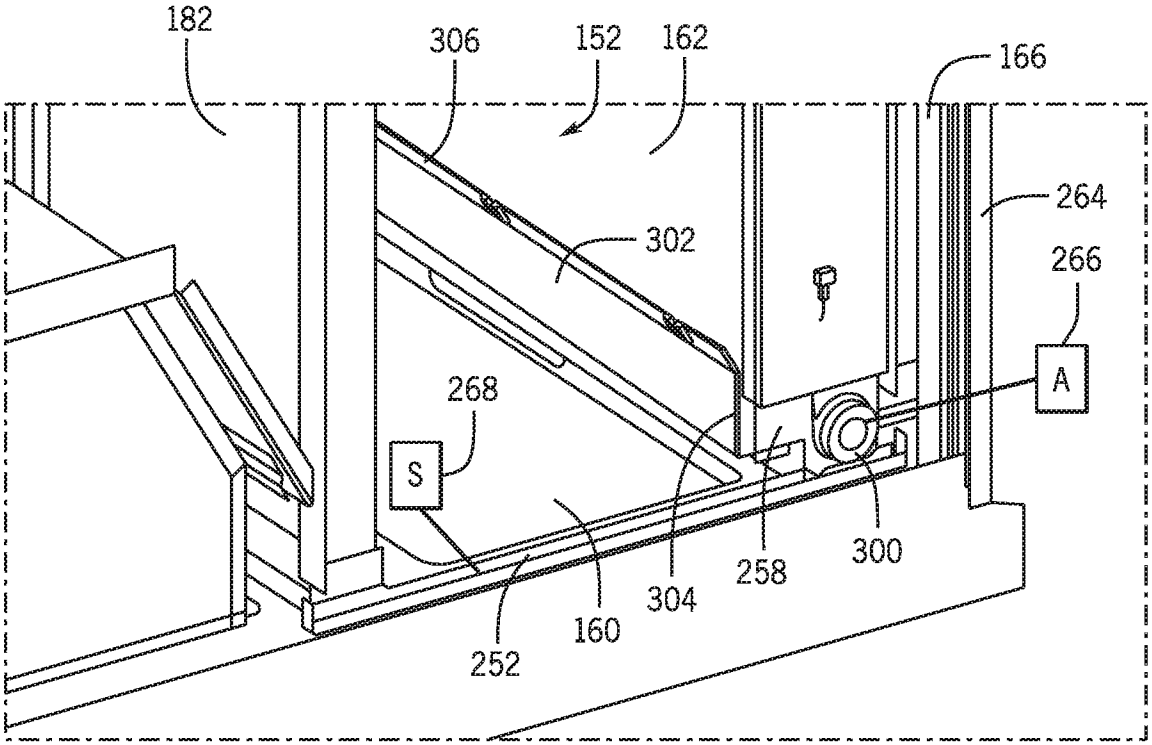
FIG. 8 is a partial perspective view of an embodiment of the HVAC system of FIGS. 5 and 6, illustrating the heat exchanger removed from or adjacent to the air flow path, in accordance with an aspect of the present disclosure.

FIG. 8 is a partial perspective view of the first volume 152 in greater detail to further show the slider 258 and the rails 252. As shown in FIG. 8, the slider 258 may include a rail engaging portion 300 configured to engage with one of the rails 252. For example, the rail engaging portion 300 may be a roller, gear, bearing, or other surface or feature configured to engage with the rail 252 and translate along the rail 252. As will be appreciated, one rail engaging portion 300 may engage with the rail 252 disposed on the first side 254 of the evaporator 162 and filter 166, and another rail engaging portion 300 may engage with another rail 252 disposed on the second side 256 of the evaporator 162 and filter 166. The rail engaging portions 300 may be disposed within a respective channel or slot of the rail 252, such that the rail 252 captures and guides movement of the rail engaging portion 300 within the rail 252.

The slider 258 may also include a base 302 configured to receive and support the evaporator 162 and/or the filter 166. For example, the base 302 may be a tray, pan, recess, or other receptacle configured to receive and retain the evaporator 162 and the filter 166 therein. In the illustrated embodiment, the base 302 includes a receptacle 304 for the evaporator 162 and/or the filter 166 to be inserted therein. The evaporator 162 and/or the filter 166 may couple to the base 302 via fasteners, punches, welds, adhesives, press fits, another method, or any combination thereof.

The base 302 may be a sliding base configured to translate along the rails 252. In particular, the base 302 may be coupled to both rail engaging portions 300 of the slider 258 and, thus, may extend from the first side 254 of the evaporator 162 and filter 166 to the second side 256 of the evaporator 162 and filter 166. As such, when the rail engaging portions 300 translate along the rails 252, the base 302 also translates along the rails 252 with the evaporator 162 and the filter 166. In some embodiments, the actuators 266 are disposed on or adjacent to the rail engaging portions 300 of the slider 258. As such, when activated, the actuators 266 translate the rail engaging portions 300 along the rails 252 to translate the slider 258 and the evaporator 162 and/or filter 166. For stability and strength to support the evaporator 162 and/or the filter 166, the rail engaging portions 300 and the base 302 may be formed from sturdy materials, such as metals, composites, another suitable material, or any combination thereof.

In certain embodiments, the base 302 includes a flange 306 extending from the base 302 and the evaporator 162 towards the additional filter 182 at an angle. Thus, when the evaporator 162 is removed or substantially removed from the air flow path 161 and is positioned towards the housing wall 264, the flange 306 may extend over the supply air section 160. In this manner, when the air flow enters the first volume 152 via the supply air section 160, the flange 306 may direct the air flow towards the additional filter 182 and the second volume 158. In some embodiments, the flange 306 may be integrally formed with the base 302 as one piece, but in additional or alternative embodiments, the flange 306 may be separate from the base 302 and may be coupled to the base 302.

Figure 9:
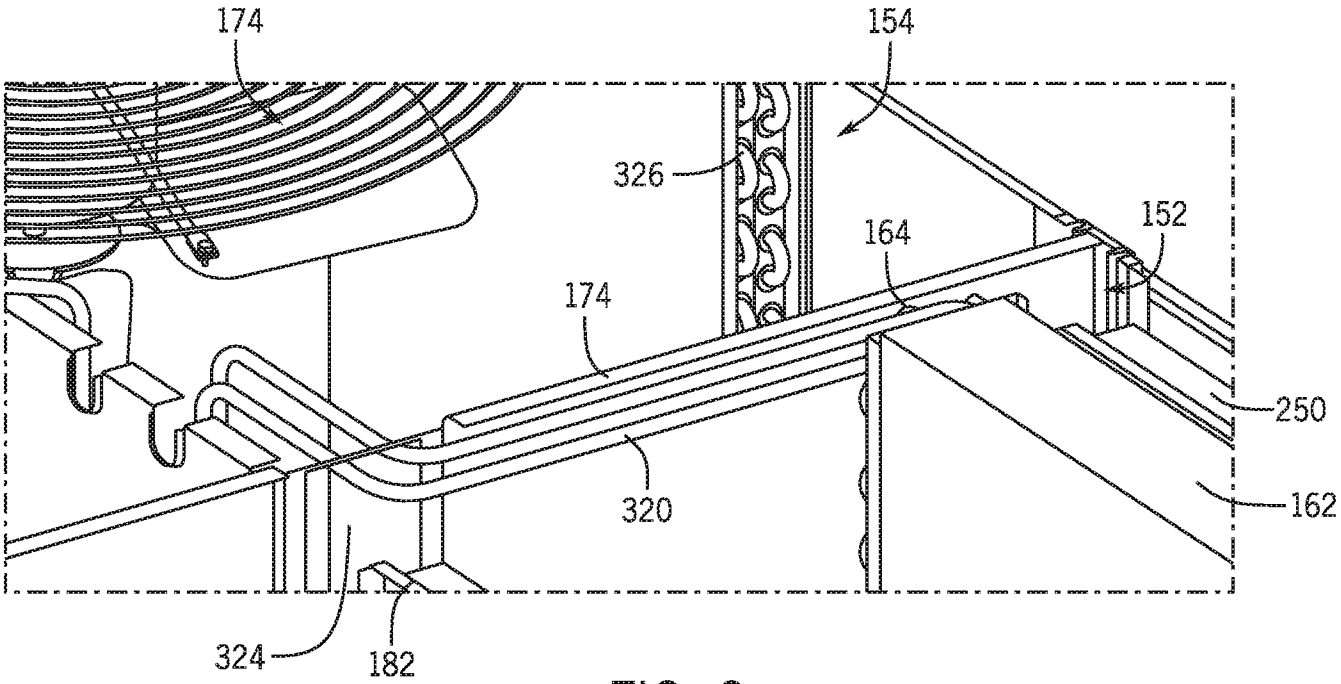
FIG. 9 is a partial perspective view of the embodiment of the HVAC system of FIGS. 5 and 6, illustrating a connection of the heat exchanger to the HVAC system, in accordance with an aspect of the present disclosure.

FIG. 9 is a partial perspective view of another section of the HVAC system 150, illustrating the second volume 154 and the first volume 152 and an embodiment of a connection between the evaporator 162 and other components of the HVAC system 150. More specifically, the illustrated embodiment shows a portion of the refrigerant circuit 179 of the HVAC system 150 and refrigerant conduit connections extending from the evaporator 162. As illustrated in FIG. 9, tubing 320 configured to flow a refrigerant therethrough extends from the evaporator 162 to the second volume 152. The tubing 320 may be coupled to the coils 164 of the evaporator 162 and may be routed through an opening 324 of the first partition 174 to extend between the first volume 152 and the second volume 154. Positioning the tubing 320 through the opening 324 permits the tubing 320 to extend through the first partition 174 rather than over the first partition 174, where the tubing 320 may be undesirably exposed or may interfere with assembly of other components of the HVAC system 150, such as a housing or shroud of the HVAC system 150. Additionally, the opening 324 may be sized to permit the tubing 320 to be routed therethrough, while also blocking air flow from flowing between the first volume 152 and the second volume 154. That is, the opening 324 may be large enough to accommodate the tubing 320, but small enough to restrict, block, or prevent air flow through the opening 324. In some embodiments, the first partition 174 may include seals configured to facilitate blocking of the air flow between the first volume 152 and the second volume 154.

In some embodiments, the tubing 320 may fluidly couple the evaporator 162 to the condenser 180, such as to coils 326 of the condenser 180, and/or the tubing 320 may couple the evaporator 162 to other components of the HVAC system, including a compressor and/or expansion device. As such, the HVAC system 150 may include multiple sections of tubing 320 coupled to the evaporator 162. As discussed in detail above, the position of the evaporator 162 within the first volume 152 may be adjusted, for example, based on an operating mode of the HVAC system 150. Accordingly, the tubing 320 may be formed from a flexible material, such as rubber, polymer, another suitable material, or any combination thereof, to enable the tubing 320 to extend, compress, or otherwise change geometry in response to a position change of the evaporator 162. In this way, the tubing 320 may remain coupled to the evaporator 162 to circulate refrigerant through the evaporator 162 irrespective of the position of the evaporator 162 within the first volume 162.

Figure 10:
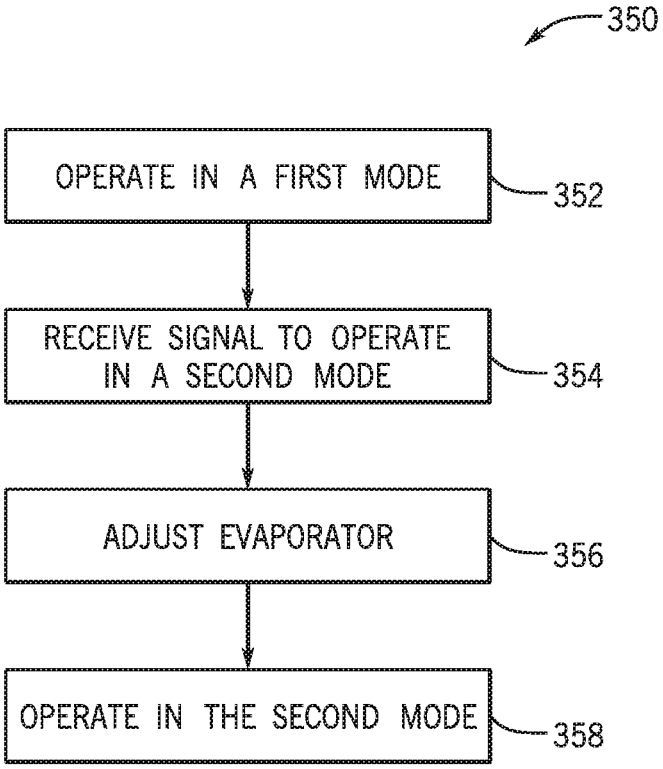
FIG. 10 is a block diagram of an embodiment of a method for adjusting a position of a heat exchanger in different operating modes of an HVAC system, in accordance with an aspect of the present disclosure.

FIG. 10 is a block diagram of an embodiment of a method 350 for adjusting the position of the evaporator 162. In block 352, the HVAC system 150 operates in a first operating mode. For example, the HVAC system 150 may operate in a cooling mode to cool an air flow circulating through the HVAC system 150 to be supplied to a conditioned space. During the first mode, the HVAC system 150 may operate the evaporator 162 to transfer heat between the air flow and refrigerant flowing through the evaporator 162 in order to cool the air flow. For example, a compressor of the HVAC system 150 may operate to circulate refrigerant through the evaporator 162. As such, the evaporator 162 is disposed within the air flow path 161 of the HVAC system 150. The velocity of the air flow may decrease as the air flow is directed across the evaporator 162. Accordingly, the blower 170 of the HVAC system 150 may also operate to increase a velocity of the air flow to a desired air flow velocity when the air flow exits the HVAC system 150 and is supplied to a conditioned space.

In block 354, the HVAC system 150 receives a signal to operate in a second mode, such as a heating mode. For example, the HVAC system 150 may receive a signal as a result of a change in a desired temperature of the space conditioned by the HVAC system 150 and/or a change in a desired temperature of the air flow in the HVAC system 150, such as via a user input. The signal may be indicative that the air flow is to be heated rather than cooled by the HVAC system 150.

As previously discussed, in the heating mode, operation of the evaporator 162 may be suspended because the air flow is not to be cooled by the refrigerant within the evaporator 162. As a result, the evaporator 162 may be removed or substantially removed from the air flow path 161 of the HVAC system 150, as shown in block 356. For example, the actuators 266 may be activated to linearly translate the slider 258 along the rails 252 to remove the evaporator 162 from the air flow path 161 within the HVAC system 150. The sensors 268 may detect when evaporator 162 is removed or substantially removed from the air flow path 161 by detecting a particular position of the evaporator 162 along the rails 252 corresponding to a location within the HVAC system 150 where air flow passing through the HVAC system 150 does not flow across the evaporator 162. Instead, the evaporator 162 may partially form a boundary of the air flow path 161 when the evaporator 162 is removed or substantially removed from the air flow path 161.

Once the evaporator 162 is removed from the air flow path 161, the HVAC system 150 may operate in the second mode, such as the heating mode, as indicated in block 358. In the second mode, operation of the evaporator 162 may be suspended. For example, operation of a compressor of the HVAC system 150 may be suspended to halt the flow of refrigerant through the evaporator 162. Suspending operation of the compressor may reduce an energy usage of the HVAC system 150 during the heating mode operation. Additionally, as the evaporator 162 is not positioned within the air flow path 161, the air flow no longer encounters fluidic resistance caused by the evaporator 162 that would otherwise decrease the velocity of the air flow through the HVAC system 150. As such, the decrease in velocity is reduced and the blower may operate at a lower power to achieve a desired velocity of the air flow exiting the HVAC system 150. In other words, the HVAC system 150 may operate the blower at a power level less than a power level of the blower during the cooling mode when the evaporator 162 is positioned within the air flow path 161.

A similar method may be implemented to switch from the second mode to the first mode. That is, the evaporator 162 may be moved into the air flow path 161 in a manner similar to that described above when the HVAC system 150 adjusts operation from a heating mode to a cooling mode. It should be appreciated that steps not already mentioned may also be performed in the method 350, such as additional steps or alternative steps, including adjusting operations of other components in the HVAC system 150. Furthermore, the steps of the method 350 may be performed automatically by the HVAC system 150, such as via the controller 178. Additionally, although this disclosure primarily discusses adjusting a position of the evaporator 162, in additional or alternative embodiments, a position of another component of the HVAC system 150 may be adjusted such that the component is no longer in the air flow path 161 based on an operating mode of the HVAC system 150.

As set forth above, an adjustable heat exchanger of the present disclosure may provide one or more technical effects useful in the operation of HVAC systems. For example, the heat exchanger may be an evaporator configured to cool air flowing in an air flow path of the HVAC system. In a cooling mode, the evaporator is disposed within the air flow path to enable the evaporator to cool the air flow. A velocity of the air flow may decrease as the air flow is directed along the air flow path and across the evaporator, and thus, a blower of the HVAC system may operate to increase the velocity of the air flow such that the air flow exits the HVAC system at a desired velocity. In a heating mode, operation of the evaporator may be suspended, and a position of the evaporator may be adjusted to remove or substantially remove the evaporator from the air flow path. As the air flow is no longer directed across the evaporator with the evaporator removed from the air flow path, any decrease in velocity of the air flow caused by fluidic resistance of the evaporator is reduced or eliminated. As such, the blower may operate at a lower power to achieve the desired velocity of the air flow, which reduces power consumption of the HVAC system. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, mounting arrangements, use of materials, colors, orientations, and the like, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosed embodiments, or those unrelated to enabling the claimed embodiments. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and/or air conditioning (HVAC) system, comprising:

a housing configured to direct an air flow through an air flow path of the housing; and an evaporator configured to translate between a first position within a volume of the housing and a second position within the volume of the housing, such that the evaporator is disposed within the air flow path in the first position and the evaporator is disposed external to the air flow path in the second position, wherein the evaporator is configured to translate in a direction of the air flow along the air flow path to translate to the first position, and the evaporator is configured to translate in an opposite direction of the air flow along the air flow path to translate to the second position.

2. The HVAC system of claim 1, wherein the evaporator is disposed on a first side of a return air inlet of the housing in the first position and disposed on a second side of the return air inlet, opposite the first side, in the second position.

3. The HVAC system of claim 1, wherein the evaporator is configured to linearly translate between the first position and the second position.

4. The HVAC system of claim 1, comprising a partition disposed within the housing and at least partially defining the volume of the housing, wherein the partition is configured to guide the air flow along the air flow path when the evaporator is in the first position and when the evaporator is in the second position.

5. The HVAC system of claim 1, comprising a controller configured to control an actuator configured to position the evaporator in the first position and configured to position the evaporator in the second position.

6. The HVAC system of claim 5, wherein the controller is configured to control the actuator to position the evaporator in the first position for a cooling mode operation of the HVAC system.

7. The HVAC system of claim 6, wherein the controller is configured to control the actuator to position the evaporator in the second position for a heating mode operation of the HVAC system.

8. The HVAC system of claim 1, wherein the HVAC system is configured to suspend operation of the evaporator in response to a determination that the evaporator is in the second position.

9. The HVAC system of claim 8, comprising a compressor configured to circulate refrigerant through the evaporator, wherein the HVAC system is configured to suspend operation of the compressor in response to the determination that the evaporator is in the second position.

10. The HVAC system of claim 1, wherein the evaporator is coupled to a condenser of the HVAC system via tubing configured to adjust in geometry during translation of the evaporator between the first position and the second position.

11. The HVAC system of claim 1, wherein the evaporator is disposed adjacent to a return air inlet of the housing, and the air flow is configured to enter the housing via the return air inlet.

12. The HVAC system of claim 1, wherein the housing comprises rails, the evaporator is positioned on the rails, and the rails are configured to guide translation of the evaporator between the first position and the second position.

13. The HVAC system of claim 1, wherein an additional volume of the housing comprises a supply air section configured to receive the air flow from the volume and direct the air flow to a space serviced by the HVAC system.

14. A controller for a heating, ventilation, and/or air conditioning (HVAC) system, comprising a tangible, non-transitory, computer-readable medium having computer-executable instructions stored thereon that, when executed, cause a processor to:

operate the HVAC system in a first mode, wherein the HVAC system is configured to direct air through an air flow path of the HVAC system and across an evaporator disposed within the air flow path in the first mode, and the evaporator is positioned within a volume defined by the HVAC system at a first side of a return air inlet in the first mode; and operate the HVAC system in a second mode, wherein the HVAC system is configured to remove the evaporator from the air flow path, position the evaporator within the volume defined by the HVAC system at a second side of the return air inlet, direct air through the air flow path of the HVAC system and adjacent to the evaporator removed from the air flow path, and suspend operation of the evaporator based on the evaporator being positioned within the volume at the second side of the return air inlet in the second mode.

15. The controller of claim 14, wherein the computer-executable instructions, when executed, cause the processor to control an actuator to translate the evaporator between a first position within the air flow path and a second position removed from the air flow path.

16. The controller of claim 15, wherein the computer-executable instructions, when executed, cause the processor to control the actuator based on data from a sensor of the HVAC system, wherein the sensor is configured to monitor a temperature of the air, a temperature within a space conditioned by the HVAC system, a location of the evaporator within the HVAC system, or any combination thereof.

17. The controller of claim 14, wherein the first mode is a cooling mode, and the second mode is a heating mode.

18. The controller of claim 14, wherein the computer-executable instructions, when executed, cause the processor to operate a blower of the HVAC system at a first power level based on the evaporator being positioned at the first side of the return air inlet, and operate the blower at a second power level based on the evaporator being positioned at the second side of the return air inlet, wherein the second power level is less than the first power level.

19. A heating, ventilation, and/or air conditioning (HVAC) unit, comprising:

a housing configured to direct an air flow through an air flow path of the housing, wherein the housing comprises a volume within the housing;

an evaporator configured to translate between a first position on a first side of a return air inlet, within the volume, and within the air flow path and a second position on a second side of the return air inlet, opposite the first side, within the volume, and external to the air flow path, wherein the housing is configured to receive the air flow via the return air inlet, and, in the first position and in the second position, the evaporator is offset from the return air inlet along a direction of travel of the evaporator between the first position and the second position; and a controller configured to control an actuator to translate the evaporator between the first position and the second position based on an operating mode of the HVAC unit.

20. The HVAC unit of claim 19, comprising a filter positioned adjacent to the evaporator, wherein the filter is configured to translate with the evaporator between the first position and the second position.

21. The HVAC unit of claim 19, comprising a blower positioned downstream of the evaporator relative to a flow direction of the air flow along the air flow path, wherein the blower is configured to increase a velocity of the air flow, the controller is configured to operate the blower at a first power level when the evaporator is in the first position, the controller is configured to operate the blower at a second power level when the evaporator is in the second position, wherein the second power level is less than the first power level.

22. The HVAC unit of claim 19, wherein the controller is configured to control the actuator to translate the evaporator toward the first position when the HVAC unit is to operate in a cooling mode.

23. The HVAC unit of claim 22, wherein the controller is configured to control the actuator to translate the evaporator toward the second position when the HVAC unit is to operate in a heating mode.

24. The HVAC unit of claim 19, comprising a sliding base disposed on rails within the housing, wherein the evaporator is disposed on the sliding base, and the actuator is configured to translate the sliding base along the rails to linearly translate the evaporator between the first position and the second position.

25. The HVAC unit of claim 19, wherein the evaporator is disposed within the housing in the first position and the second position.

26. The HVAC unit of claim 19, wherein the evaporator partially defines a boundary of the air flow path when the evaporator is in the second position.

27. The HVAC unit of claim 19, comprising a partition that at least partially defines the volume and an additional volume within the housing, wherein the HVAC unit comprises a condenser positioned within the additional volume, and the condenser is fluidly coupled to the evaporator.

* * * * *